United States Patent [19]

Mitchell

[11] 4,397,292

[45] Aug. 9, 1983

[54] CIRCULATING AIR SPACE HEATER

[76] Inventor: Francis Mitchell, 702 E. 8th, Winfield, Kans. 67156

[21] Appl. No.: 310,273

[22] Filed: Oct. 9, 1981

[51] Int. Cl.[3] ..... F24B 3/00

[52] U.S. Cl. ..... 126/61; 126/66; 126/67; 126/77; 165/DIG. 2

[58] Field of Search ..... 126/61, 63, 65, 66, 126/67, 70, 72, 77, 15 R, 15 A, 193; 165/DIG. 2; 237/55

[56] References Cited

U.S. PATENT DOCUMENTS

| | | | |
|---|---|---|---|
| 4,140,101 | 2/1979 | Glover | 126/61 |
| 4,184,473 | 1/1980 | McIntire | 126/66 |
| 4,186,718 | 2/1980 | Goodwin | 126/66 |
| 4,198,952 | 4/1980 | Mitchell | 126/61 |
| 4,200,086 | 4/1980 | Kolb | 165/DIG. 2 |
| 4,204,517 | 5/1980 | Rumsey | 126/66 |
| 4,206,742 | 6/1980 | Johnson | 237/55 |
| 4,213,443 | 7/1980 | Morande | 126/72 |
| 4,214,569 | 7/1980 | Heine | 126/67 |
| 4,258,693 | 3/1981 | Baker | 126/61 |
| 4,347,831 | 9/1982 | Graziano | 126/67 |

*Primary Examiner*—Daniel J. O'Connor
*Attorney, Agent, or Firm*—Fisher, Christen & Sabol

[57] ABSTRACT

A solid fuel burning modular stove fabricated from a plurality of metal assemblies includes a first assembly provided with a combustion chamber, an air duct at the lower front of the chamber communicating with the ambient air, a louver member inside the air duct varying the degree of admittance of air through the duct, flue pipe means for exhausting combustion products from the stove, a plurality of fire brick lining the floor, rear and side walls. Vertical ducts are positioned along the rear and side walls having inlet openings at their bottom and outlet openings at their tops, heated air rises through the ducts and discharges into the ambient air. A second assembly to be attached to the bottom of the first assembly comprising horizontal channel means in communication with the vertical duct inlets providing a blower to force outside air through the vertical ducts. A third assembly comprising generally horizontal channel means to be attached to the top of the first assembly in communication with the vertical duct outlets for conducting heated air to a reclaimer chamber in heat exchanging relationship with the flue pipe. The blower, and the louver member may be controlled by an electric thermostat providing except for the introduction of fuel a fully automatic forced air heating system.

5 Claims, 5 Drawing Figures

CIRCULATING AIR SPACE HEATER

BACKGROUND OF THE INVENTION

This invention relates to new and useful improvements in heating units such as, for example, a stove arranged for home use.

Many types of stoves have heretofore been provided for burning wood, coal and the like, and intended primarily to furnish heat to room areas.

Conventional stoves are notoriously inefficient room heaters because when used they draw much of the heated air up through the flue pipe for exit to the atmosphere. Most of the heat produced by the fire is thus transferred to the draft air which is promptly released to the outside atmosphere, rather than to the air contained within the building. In addition, because air is being withdrawn from the dwelling, creating a relatively low pressure therein, air is simultaneously drawn into the dwelling to replace it. It has been found that a direct supply of outside air to the stove diminishes energy losses because stove heated air is not removed, nor is there a constant influx of cold outside air into the interior of the building. Numerous device's exist in the prior art for extracting heat from a firebox. Some run tubes through the coals and burning material and discharge air through the tubes. Stoves of this type are represented in U.S. Pat. Nos. 195,104 and 4,166,444. The wood burning stoves commonly employed generally are extremely inefficient as heating sources. Most of them rely upon radiations and convection currents of air within the room coming into contact with the outside walls of the stove to produce heated air. In such stoves the major portion of the heat produced by the combustion of the wood or other combustible products in the stove is lost with the combustion products out the flue or smoke stack. This is one of the greatest drawbacks of self-contained room size wood burning stoves. In addition, the room itself is not uniformly heated. The region immediately adjacent the stove is too hot, while the more remote corners or sides of the room obtain relatively little heat from the stove.

Some early models of wood burning heating stoves, in attempts to overcome the inefficiency of such stoves, relied upon rather extensive baffles between the upper portion of the combustion chamber and the outlet for the flue in order to force the combustion products to take a tortuous path from the upper portion of the combustion chamber to the flue. This resulted in retention of more heat within the stove and an improvement in radiation of this heat from the stove. The operation, however, is still relatively inefficient and a large amount of heat loss results. Stoves of this type are shown in U.S. Pat. Nos. 585,027, 1,400,299, 2,238,345, 2,316,392, 2,789,554, 4,127,100, 4,129,251, 4,136,663 and 4,150,658.

Other early wood burning stove's had double walls along at least a portion of their fire chamber's to create an air chamber heated on one side by one of the walls of the fire chamber. An air inlet was provided near the bottom of the air chamber and appropriate air outlets were created near the top. Air rose by convection current through the air chamber and out the outlets. Thus, this air was heated in addition to the air coming in contact with the outside of the stove. Improved efficiency did result, but the bulk of the heat generated by the process of combustion was lost in the flue. Stoves of this type are represented in U.S. Pat. Nos. 128,989, 1,469,463, 2,345,329, 4,136,662 and 4,140,101.

SUMMARY OF THE INVENTION

According to the present invention and forming a primary objective thereof, a stove fabricated from sheet metal modular assemblies is provided which is simplified in construction and which at the same time utilizes efficiently the heat produced from the combustion chamber of a stove. The objectives of the invention are accomplished by the use of a first modular assembly comprising an enclosed combustion chamber including a floor lined with fire bricks; an air duct at the lower front of the first assembly for conducting outside air into the stove; a movable louver member inside the duct for varying the degree of admittance of air into the stove; and a flue at the rear of the combustion chamber and near the top thereof; the side, and rear walls of the combustion chamber are lined with fire brick; a plurality of spaced vertical ducts positioned along the rear and side walls staggered between the fire bricks extending substantially from the bottom to the top of the rear and side walls having air inlet openings at the bottom of the vertical ducts to allow air to rise from the bottom, and air outlet opening's at the top to allow the air to discharge into the ambient air; a pivotally mounted door in the front wall to provide access to the stove for the introduction of wood or other solid fuel.

Preferably, the first assembly of the stove is combined with a second modular assembly comprising a U-shaped horizontal channel that is attached to the bottom of the first assembly being in communication with the vertical ducts of the first assembly, and providing an electric blower whereby outside air can be blown through the vertical ducts providing increased circulation.

In a preferred embodiment, a third modular assembly is provided comprising a generally horizontal channel that is attached to the top of the first stove assembly being in communication with the vertical duct outlets of the first assembly for conducting heated air from the outlets to a reclaimer chamber assembly which is subdivided into air inlet and outlet manifolds, and a heat exchange subchamber being disposed between the two outlets; the subchamber is provided with an inlet opening at the bottom for the introduction of combustion smoke and heated gases from the first assembly which combines with the heated air introduced from the horizontal channel means to produce double-heated air for discharge into the ambient air or into existing heat system duct for supplementary heat, or into a duct system installed specifically into the wood stove to other parts of the building. The air is blown through the complete stove by the blower attached to the second assembly. The duct system of the third assembly is utilized to carry excess heat through the heat reclaimer into the existing duct work of a building to heat other areas of a building.

To provide for the maximum burn time of a load of fuel, the air duct louver member may be adjusted by an electric thermostatically controlled damper motor, whereby the air supplied to the combustion chamber is regulated between zero and a predetermined maximum rate. The blower motor in the second assembly may be controlled by an electric thermostat, providing, except for the introduction of fuel when all three modular assemblies are utilized, a fully automatic forced air duct heating system.

The primary object of the invention is to provide for a stove ranging from a simple circulating heater, manually controlled, to a semi-automatic forced air duct heat system, by utilizing optional modular assemblies with the basic construction.

It is an object of the present invention to provide a stove which is more efficient in operation, yet rugged and reliable in construction.

It is still another object of the present invention to provide a stove which can be easily hooked into the duct work of most existing gas and oil furnaces to be used either independently or as a supplemental heating unit.

It is still another object of the present invention to provide a stove having a convenient and easily operated draft control.

It is yet another object of the present invention to provide a means of supplying air to the combustion chamber from a source outside the room in which the stove is located.

Another object of the present invention is to provide for the recovery of otherwise wasted heat from the combustion chamber and flue pipe and to discharge this-reclaimed heated air into the buildings duct system or into the buildings ambient air, as the case may be.

Yet another object of the present invention is to provide a stove construction which enables thermostatic control of delivery of external air to the interior of the stove, and for the discharge of heated air to the ambient air.

The foregoing and other objects and advantages of this invention will appear from the following detailed description, taken in connection with the accompanying drawings of a preferred embodiment.

DESCRIPTION OF THE PREFERRED EMBODIMENT

Figure 1:
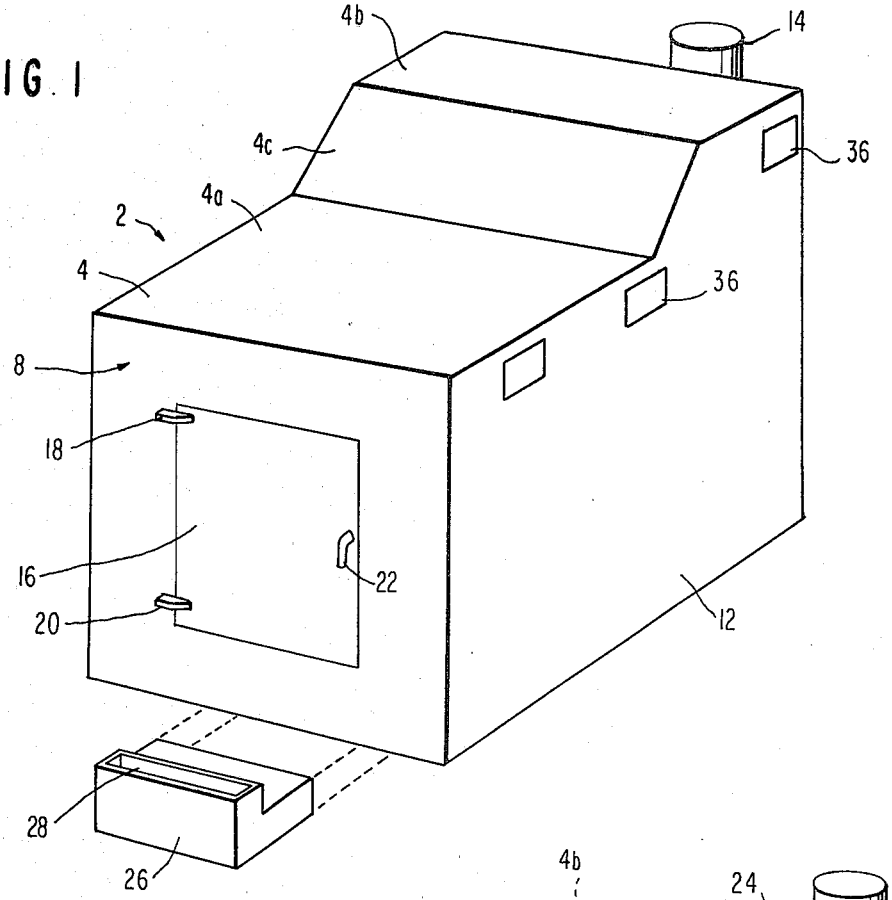
FIG. 1 is a perspective view of a stove embodying the basic principals of the invention.
Figure 2:
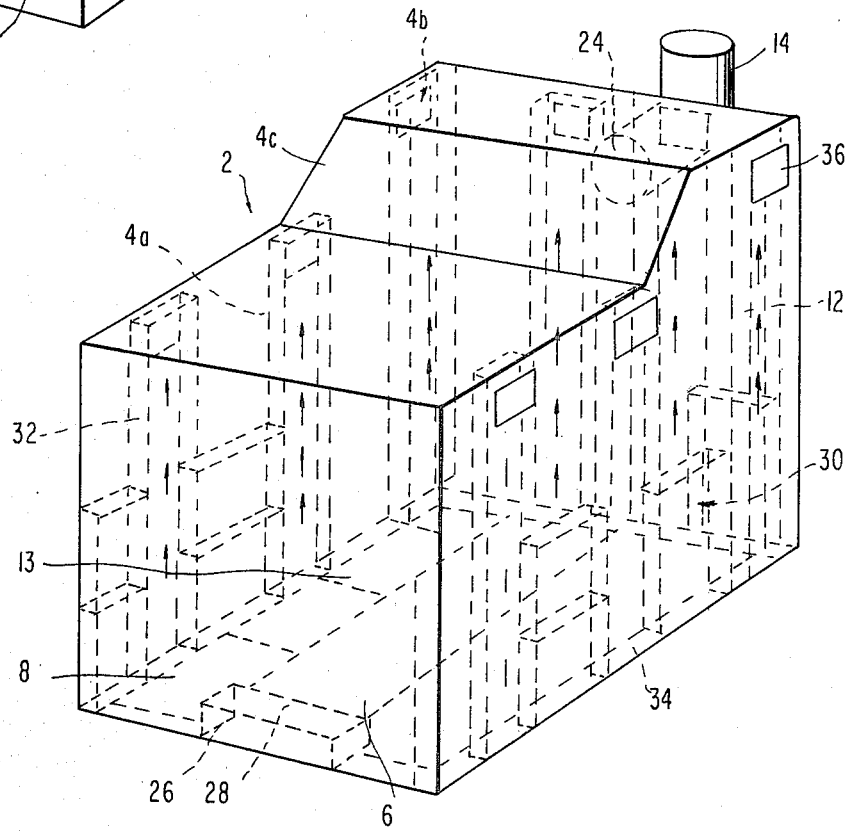
FIG. 2 is a three dimensional view, with parts broken away, of FIG. 1.

Referring to FIGS. 1 and 2, there is shown in perspective and three-dimensional views the first assembly of the invention. The stove 2 includes a generally rectangular floor 6 to which are joined side walls 12 and a rear wall 10 and a front wall 8. These parts may be made from sheet metal, although other suitable materials can be used by those skilled in the art. The front, rear and side walls support and are joined to the stove top 4. The top consists of a forward section **4*a*, a smaller rear section 4*b* at a higher level than the forward section, and a short, nearly vertical section 4*c* joining the two. The complete assembly of walls defines a combustion chamber 13 with fire brick 30 forming the floor of the chamber. A door 16 is suspended from hinges 18 and 20** which are attached to the front wall.

A latch 22 allows the door to be opened for loading the combustion chamber with fuel. When there is a fire in the combustion chamber, the latch holds the door tightly closed so as to minimize undesired incursion of air to the chamber.

At the rear of the chamber and near the top thereof is a flue 24 through which combustion products can escape, the flue is connected to the flue pipe 14 which conducts the combustion products to the outside air.

An air duct 26 is located at the lower front of the front wall, providing for the introduction of outside air into the combustion chamber, and a louver member 28 is located inside the air duct which may be adjusted to control the supply of air being conducted into the combustion chamber from a rate of zero, to a predetermined maximum rate.

As shown in FIG. 2, the side and rear walls are lined with fire brick 30. A plurality of spaced vertical ducts 32 are provided positioned within and along the rear 10 and side walls 1 staggered between the fire bricks 30, extending substantially from the bottom to the top of the rear and side walls. The vertical ducts have air inlet openings 34 at the bottom to allow air to rise convectively from the bottom and air outlet openings 36 extending through the adjacent side walls 12 near the top to allow the heated air to discharge into the ambient air.

Figure 3:
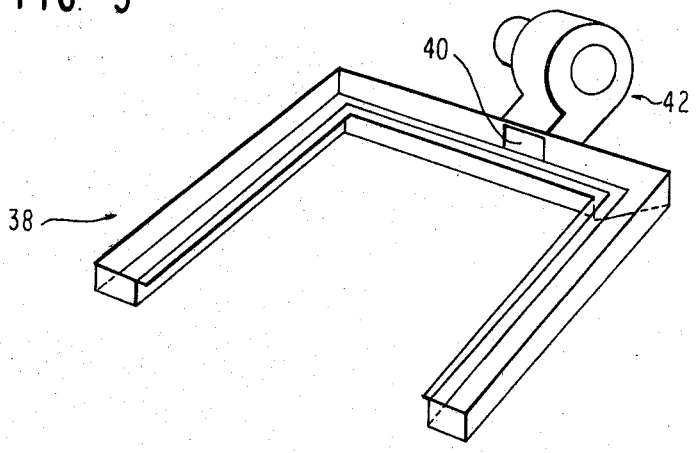
FIG. 3 is a perspective view illustrating an optional assembly of a horizontal U-shaped duct provided with a blower.
Figure 5:
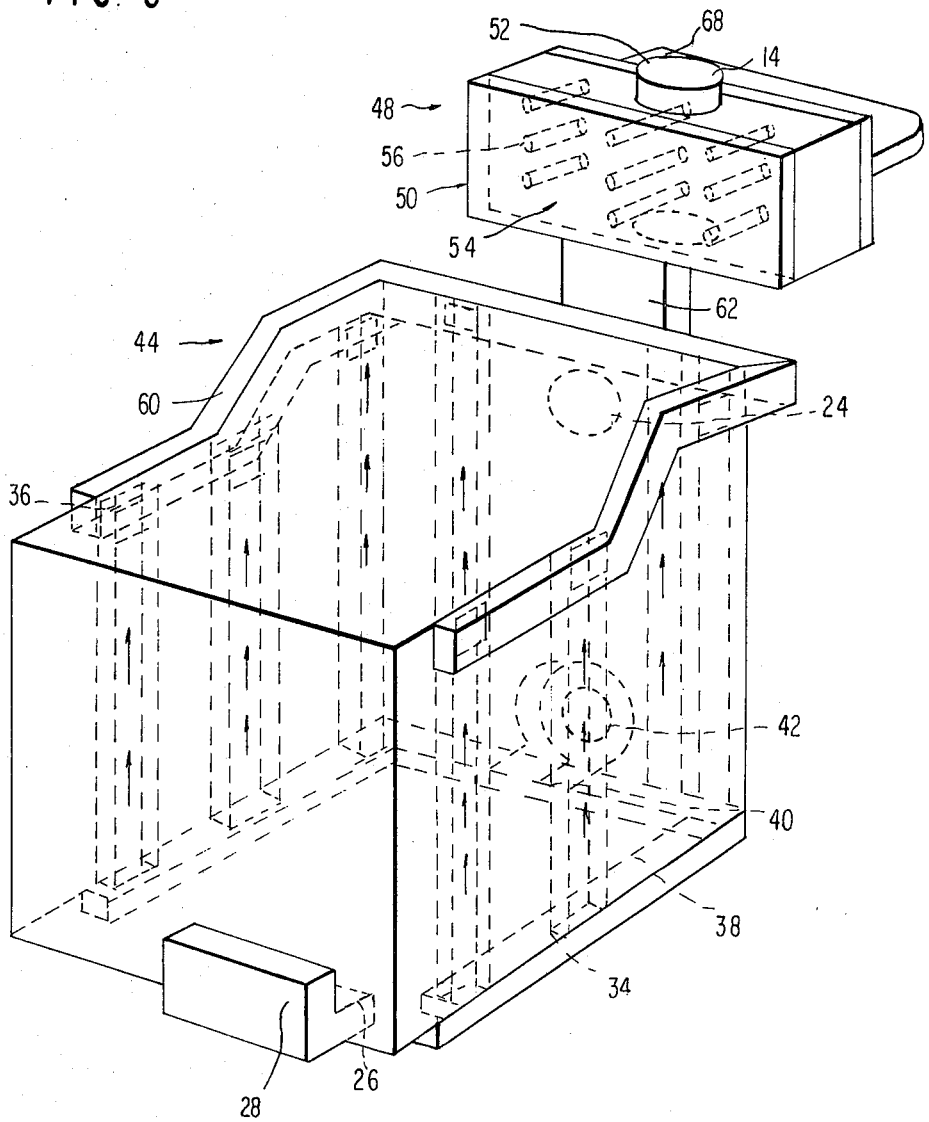
FIG. 5 is a three dimensional perspective view of the invention with all assemblies attached.

The first assembly is a circulating stove that is designed to provide heated air to a series of vertical ducts through which air flows by convection. As the demand for more heat is required, the addition of a second modular assembly providing for added circulation is preferred. As shown in FIGS. 3 and 5, the second assembly comprises U-shaped horizontal channel means 38 that are attached to the bottom of the first assembly, being in communication with the vertical duct inlets 34. The channel is provided with an inlet 40 which houses a blower 42 for increasing the air flow into the vertical ducts. The blower forces ambient air up through the vertical ducts and back out into the room through the vertical duct air outlets 36 at a predetermined rate.

Figure 4:
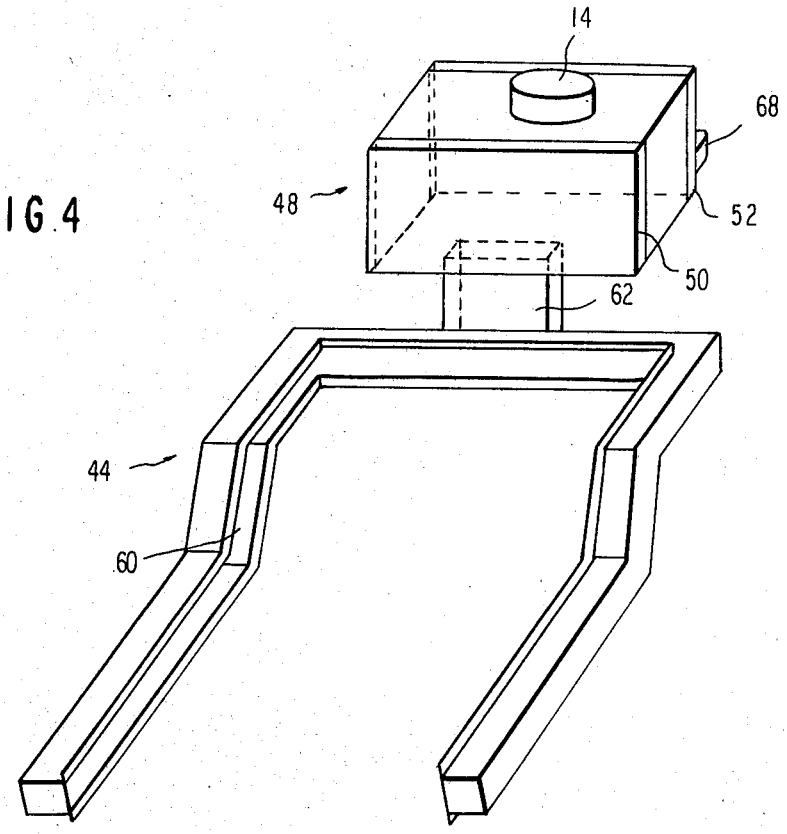
FIG. 4 is a perspective view of an optional assembly of an outside generally horizontal duct system provided with a reclaimer.

As shown in FIGS. 4 and 5 to eliminate the heat that is wasted due to heat being drawn up through the flue pipe, a third modular assembly 44 includes a reclaimer chamber 48 subdivided into an air inlet manifold 50, an air outlet manifold 52, and a heat exchange subchamber 54 is disposed between the two manifolds. The subchamber is provided with a plurality of horizontal passageways 56 communicating between the inlet and outlet manifolds. The subchamber is provided with an inlet opening 58 which communicates with the flue pipe for the introduction of combustion products. The combustion products are in heat exchanging relationship with the horizontal passageways. The third assembly 44 further comprises horizontal channel means 60 attached to the top of the first assembly 2 in communication with the vertical duct outlets for conducting heated air from the outlets to the reclaimer. The channel means extend rearwardly from the outlet openings 36 in the vertical ducts 32 around the upper edge of the stove. The reclaimer 48 joins and is supported by a vertical duct 62 which is attached to the channel means 60 and extends upwardly communicating with the inlet manifold 50 of the reclaimer. The horizontal channel means 60 is provided with fan means 42 located in the middle of the lower channel means 38. The fan means provide for the heated air rising through the vertical ducts 32 into the channel means 60 to blow up the vertical duct 62 that joins the reclaimer inlet manifold 50 and conduct the air through the horizontal passageways 56 where the air is further heated by picking up heat from the heated walls of the passageways. The heated air then enters the outlet manifold 52 and exits through the duct 68 into another area of the building.

In use, the stove functions in the following way, viewing FIG. 2. Fuel is placed in the combustion chamber 13 and ignited, after which the door 16 is closed. The louver 28 in the air duct 26 is then opened a desired amount to allow air to enter the combustion chamber. As the fuel is consumed by flames, hot gases and smoke rise from the fire upwardly and rearwardly toward the rear of the combustion chamber where the flue 24 is located, and exit via the flue pipes. As the hot gases rise, they contact the vertical ducts 32, thus heating the metal from which the ducts are fabricated. As the fire creates a draft effect, air is drawn into the air inlet openings 34 in the vertical ducts, and rise convectively through the ducts where it picks up heat from the heated walls of the ducts. The heated air rises to the top of the vertical ducts and discharges through the air outlet openings 36 into the ambient air.

As shown in FIGS. 3 and 5 when a greater amount of circulation is desired, the second modular assembly 38 is utilized providing for increased circulation through the use of the blower 42. The blower forces ambient room air through the horizontal channel means 38 and up through the vertical ducts 32 and back into the room through the outlets 36. Although use of a blower is not absolutely necessary, since heated air will flow by convection through the vertical ducts, use of the blower 42 is preferred to increase the air flow because more heat is extracted from the vertical duct walls.

As shown in FIGS. 4 and 5 the third assembly 44 is utilized to carry excess heat from the second assembly 38 and for the recovery of otherwise wasted heat from the flue pipe 14 into an existing heat duct system (not shown) for supplementary heat or into an independent system (not shown) installed in the stoves duct system to heat other parts of the buildings. The horizontal channel means 60 are in communication with all of the outlet opening's 36 through which heated air is conducted into the channel 60. The blower 42 in the channel means 38 forces air through the vertical duct 62 into the inlet manifold 50 where it passes through the horizontal passageways 56 picking up heat before entering the outlet manifold 52 and exiting through the duct 68 to another area of the building.

Electric thermostatically controlled damper motor means preferably are provided for controlling the adjustment of the louver 28 and also electric thermostat control means is provided for the control of the blower motor 42.

Another embodiment of the invention provides for the stove 2 to be used without the outside horizontal ducts 44, and without the U-shaped horizontal duct 38 of the second assembly. This embodiment provides for the stove as a closed heating system to be used in conjunction with an outside heat duct system. The blower motor 42 from the second assembly may be attached to the front cover of the first manifold 50 by means of expanding or attaching an extension hood to the front cover of the first manifold. This blower has no access to ambient air, but rather is a pusher type fan to push heated air from inside the heat reclaimer 54 into an existing heat duct system. This heat duct system would also be connected back into the stove providing a closed heating system.

Having described the preferred embodiments of the invention, it is to be understood that the invention is not limited thereto, but may be otherwise embodied within the scope of the following claims.

What I claim is:

1. A stove for burning solid fuel fabricated from a plurality of sheet metal modular assemblies comprising:

(a) a first assembly comprising a combustion chamber with sheet metal top, floor, front, rear and a pair of oppositely disposed side walls, an air duct at the lower front of said first assembly for conducting outside air into said stove, a movable louver member inside said duct varying the degree of admittance of said air through said duct, flue pipe means having one end at a location inside said stove and the other end for exhausting combustion products from said stove, (a) a plurality of fire bricks lining said floor, said rear, and said side walls, (c) a plurality of sheet metal spaced vertical ducts positioned along said rear wall and said side walls staggered between said fire bricks lining said rear wall and said side walls extending substantially from the bottom to the top of said rear wall having air inlet openings at the bottom of said vertical ducts to allow air to rise from the bottom through said ducts, and air outlet openings at the top of said vertical ducts to allow said air to discharge into the ambient air, (d) a second assembly comprising horizontal channel means to be attached to the bottom of said first assembly in communication with said vertical duct inlets, said channel having an inlet provided with blower means for conducting outside air into said vertical ducts, (e) a pivotally mounted door in the front wall to provide access to the stove for the introduction of wood or other solid fuel.

2. The stove according to claim 1, wherein a third assembly comprises a generally horizontal channel means to be attached to the top of said first assembly in communication with said vertical duct outlets for conducting heated air from said outlets to the ambient air.

3. The stove according to claim 2, wherein said third assembly further comprises reclaimer means in heat exchanging relationship with said flue pipe means.

4. The stove according to claim 3, wherein said reclaimer comprises a chamber subdivided into an air inlet manifold, an air outlet manifold, and a heat exchange subchamber disposed between said inlet and said outlet manifolds, a plurality of horizontal passageways communicating between said inlet and said outlet manifolds, said heat exchange subchamber being provided with an inlet opening at the bottom for combustion products from said first assembly, and an outlet opening at the top for discharge of said combustion products.

5. The stove according to any one of claims 1, 2, 3 or 4, further comprising electric thermostatically controlled damper motor means for controlling the adjustment of said louver, and also includes electric thermostat control means for the blower means in said second assembly, and fan means in said third assembly.

* * * * *